US011499787B2

(12) United States Patent
Liu et al.

(10) Patent No.: US 11,499,787 B2
(45) Date of Patent: Nov. 15, 2022

(54) IN-PROCESS ROLL-BOND PLATE AND METHOD FOR MANUFACTURING A ROLL-BOND HEAT EXCHANGER

(71) Applicant: VAST GLORY ELECTRONIC & HARDWARE & PLASTIC (HUI ZHOU) LTD, Hui Zhou (CN)

(72) Inventors: Lei Lei Liu, Hui Zhou (CN); Yousen Lin, Hui Zhou (CN)

(73) Assignee: VAST GLORY ELECTRONIC & HARDWARE & PLASTIC (HUI ZHOU) LTD, Hui Zhou (CN)

( * ) Notice: Subject to any disclaimer, the term of this patent is extended or adjusted under 35 U.S.C. 154(b) by 116 days.

(21) Appl. No.: 16/593,055

(22) Filed: Oct. 4, 2019

(65) Prior Publication Data

US 2020/0191492 A1 Jun. 18, 2020

(30) Foreign Application Priority Data

Dec. 14, 2018 (CN) ..... 201811534584.5

(51) Int. Cl.
*F28D 9/00* (2006.01)
*F28D 21/00* (2006.01)

(52) U.S. Cl.
CPC .... *F28D 9/0081* (2013.01); *F28D 2021/0063* (2013.01)

(58) Field of Classification Search
CPC ..... F28D 15/0275; F28D 15/0283; F28D 9/0081; F28D 2021/0063; F28D 2021/0064; F28F 3/14; F28F 3/00; B21D 53/045; B23P 2700/09
See application file for complete search history.

(56) References Cited

U.S. PATENT DOCUMENTS 3,380,518 A 4/1968 Canteloube et al.
5,029,389 A * 7/1991 Tanzer ..... F28D 15/0283 29/890.032
5,076,351 A * 12/1991 Munekawa ..... F28D 15/0283 165/104.21
5,379,830 A * 1/1995 Itoh ..... F28D 15/0233 165/104.14

(Continued)

FOREIGN PATENT DOCUMENTS

CN 105352352 A 2/2016
TW 201403017 A 1/2014

*Primary Examiner* — Jianying C Atkisson
*Assistant Examiner* — Jose O Class-Quinones
(74) *Attorney, Agent, or Firm* — Dickinson Wright PLLC

(57) ABSTRACT

A method for manufacturing a roll-bond heat exchanger has steps of: (1) A preparing step: preparing an in-process roll-bond plate that has a main plate with a bulged structure, and a degassing portion with a tube; (2) A degassing step: removing air from the bulged structure through the tube; (3) A filling step: filling refrigerant into the bulged structure; (4) A pressing step: pressing the bulged structure flat to form a pressed portion; (5) A cutting step: cutting the degassing portion to form a cut portion on the main plate; and (6) A sealing step: welding the cut portion. The main plate and the degassing portion are integrally formed as a single part and the degassing portion is able to be directly connected with the vacuum filling machine. Accordingly, processing steps and manpower for manufacturing the roll-bond heat exchanger are reduced.

6 Claims, 11 Drawing Sheets

(56) References Cited

U.S. PATENT DOCUMENTS

| | | | | |
|---|---|---|---|---|
| 6,230,407 | B1 * | 5/2001 | Akutsu | F28D 15/0233 29/890.032 |
| 2005/0178532 | A1 * | 8/2005 | Meng-Cheng | F28D 15/0233 165/104.33 |
| 2009/0040726 | A1 * | 2/2009 | Hoffman | F28D 15/0233 361/700 |
| 2012/0305222 | A1 * | 12/2012 | Yang | F28D 15/046 165/104.26 |
| 2014/0182819 | A1 * | 7/2014 | Yang | F28D 15/04 165/104.26 |
| 2019/0195567 | A1 * | 6/2019 | Wang | F28F 3/12 |
| 2019/0212039 | A1 | 7/2019 | Zhang et al. | |

* cited by examiner

IN-PROCESS ROLL-BOND PLATE AND METHOD FOR MANUFACTURING A ROLL-BOND HEAT EXCHANGER

CROSS-REFERENCE TO RELATED APPLICATIONS

This application is based upon and claims priority under 35 U.S.C. 119 from China Patent Application No. 201811534584.5 filed on Dec. 14, 2018, which is hereby specifically incorporated herein by this reference thereto.

BACKGROUND OF THE INVENTION

1. Field of the Invention

The present invention relates to a heat exchanger, especially to an in-process roll-bond plate for further processing and a method for manufacturing a roll-bond heat exchanger.

2. Description of the Prior Art(s)

A conventional roll-bond heat exchanger is manufactured by printing a pre-designed channel pattern on a first aluminum sheet, combining the first aluminum sheet and a second aluminum sheet without channel pattern together into a single roll-bond plate through a roll bonding process, and bulging the roll-bond plate by high pressure nitrogen to form a channel having a required diameter along the channel pattern. The channel may be filled with refrigerant. The conventional roll-bond heat exchanger is flat in appearance, has high heat transfer efficiency, and is often used as an evaporator.

FIGS. 8 to 11 show processes of filling the conventional roll-bond heat exchanger with the refrigerant.

With reference to FIG. 8, an opening of a duct 91 protruding from a side edge of the roll-bond plate 90 is enlarged to an expanded opening 911, a proximal end of an aluminum tube 92 having smaller diameter than the expanded opening 911 is inserted into the expanded opening 911, and then the proximal end of the aluminum tube 92 and the roll-bond plate 90 are welded together.

With further reference to FIG. 9, a connecting pipe of a vacuum filling machine is connected to a distal end of the aluminum tube 92 to degas the roll-bond plate 90 and fill the roll-bond plate 90 with the refrigerant. By performing a first pressing step with a pressing device, a first pressed portion 921 is formed on the aluminum tube 92 to press the aluminum tube 92 flat and to seal the aluminum tube 92.

With further reference to FIG. 10, by performing a second pressing step, a second pressed portion 922 is formed on the duct 91 of the roll-bond plate 90 to press the duct 91 flat.

With further reference to FIG. 11, then the duct 91 is cut from a position between the first pressed portion 921 and the second pressed portion 922 and is flush with the side edge of the roll-bond plate 90.

However, in the above-mentioned processes, it is needed to additionally enlarge the opening of the duct 91 and weld the aluminum tube 92 to the duct 91 of the roll-bond plate 90 and to perform the two pressing steps, which costs not only the aluminum tub 92 but also processing steps and manpower. Accordingly, it costs high manufacturing cost to manufacture the roll-bond heat exchanger by the conventional roll-bond plate 90 in the conventional processes.

To overcome the shortcomings, the present invention provides an in-process roll-bond plate and a method for manufacturing a roll-bond heat exchanger to mitigate or obviate the aforementioned problems.

SUMMARY OF THE INVENTION

The main objective of the present invention is to provide an in-process roll-bond plate and a method for manufacturing a roll-bond heat exchanger.

The in-process roll-bond plate has a main plate and a degassing portion. The main plate has a bulged structure formed on a side surface of the main plate. The degassing portion protrudes from the main plate and has a tube communicating with the bulged structure. The degassing portion and the main plate are integrally formed as a single part The method for manufacturing the roll-bond heat exchanger has the following steps.

(1) A preparing step: preparing an in-process roll-bond plate as described above.

(2) A degassing step: connecting the tube of the degassing portion to a connecting tube of a vacuum filling machine to remove air from the bulged structure.

(3) A filling step: filling refrigerant into the bulged structure that has been degassed by using the vacuum filling machine.

(4) A pressing step: pressing the bulged structure flat to form a pressed portion by using a pressing device.

(5) A cutting step: cutting the degassing portion by using a cutting device to form a cut portion on the main plate.

(6) A sealing step: welding the cut portion by using a welding device.

Since the main plate and the degassing portion are integrally formed as a single part and the degassing portion is able to be directly connected with the vacuum filling machine, it is not needed to additionally weld an adapting tube to the main plate and enlarge the opening of the tube. Accordingly, processing steps and manpower for manufacturing the roll-bond heat exchanger are reduced. Moreover, the U-shaped structure of the insertion portion allows the roll-bond heat exchanger to be firmly and stably inserted on a base of a heat dissipating device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
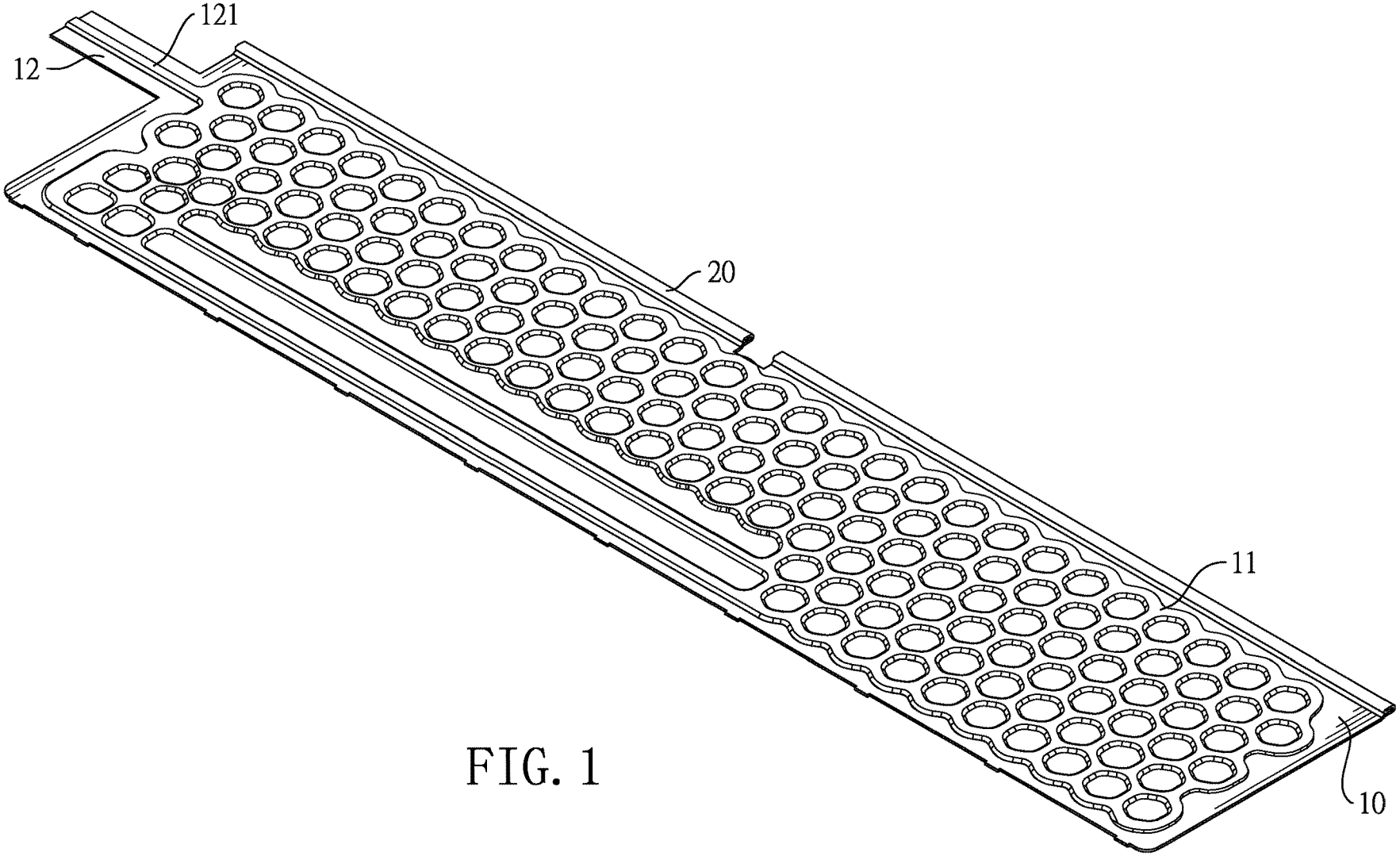
FIG. 1 is a perspective view of an in-process roll-bond plate in accordance with the present invention.

With reference to FIG. 1, an in-process roll-bond plate in accordance with the present invention comprises a main plate 10, a degassing portion 12, and an insertion portion 20.

Figure 2:
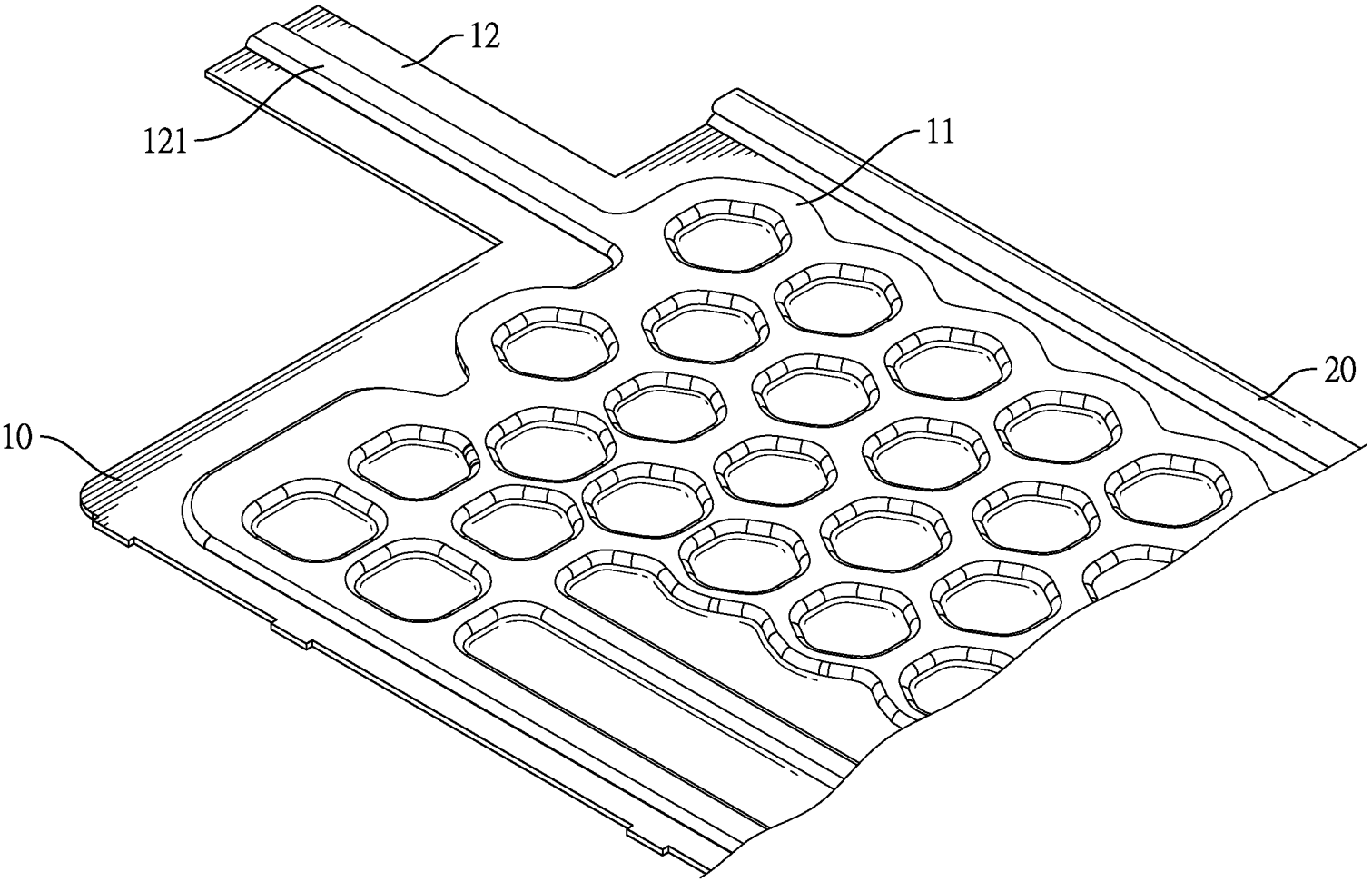
FIG. 2 is an enlarged perspective view of the in-process roll-bond plate in FIG. 1.

With reference to FIGS. 1 and 2, the main plate 10 has a bulged structure 11 formed on a side surface of the main plate 10.

The degassing portion 12 protrudes from the main plate 10 and has a tube 121 communicating with the bulged structure 11. The degassing portion 12 and the main plate 10 are integrally formed as a single part.

In the preferred embodiment, the bulged structure 11 is formed as a reticular channel. The tube 121 of the degassing portion 12 has a proximal end and a distal end. The proximal end of the tube 121 is connected to and communicates with the bulged structure 11 of the main plate 10. The distal end of the tube 121 communicates with an exterior of the main plate 10 and is for being connected to a vacuum filling machine.

Preferably, a diameter of the tube 121 of the degassing portion 12 is, but is not limited to, 50 millimeter (mm).

The insertion portion 20 is U-shaped in cross-section and is formed on a side edge of the main plate 10. In the preferred embodiment, the insertion portion 20 is used for combined with a base. The base may be a part of a conventional heat dissipating device and have multiple elongated insertion slots. The insertion portion 20 is inserted in a corresponding one of the insertion slots.

With reference to FIGS. 2 to 7, a method for manufacturing a roll-bond heat exchanger comprises the following steps.

(1) A preparing step S1: with reference to FIG. 2, preparing the in-process roll-bond plate as described above. The roll-bond plate is conveyed to a processing zone via a conveying device.

(2) A degassing step S2: connecting the tube 121 of the degassing portion 12 to a connecting tube of a vacuum filling machine to remove air from the bulged structure 11 by using the vacuum filling machine.

(3) A filling step S3: filling refrigerant into the bulged structure 11 that has been degassed by using the vacuum filling machine. The vacuum filling machine is able to create a vacuum inside the bulged structure 11 and then fills the refrigerant into the bulged structure 11 on one machine.

Figure 3:
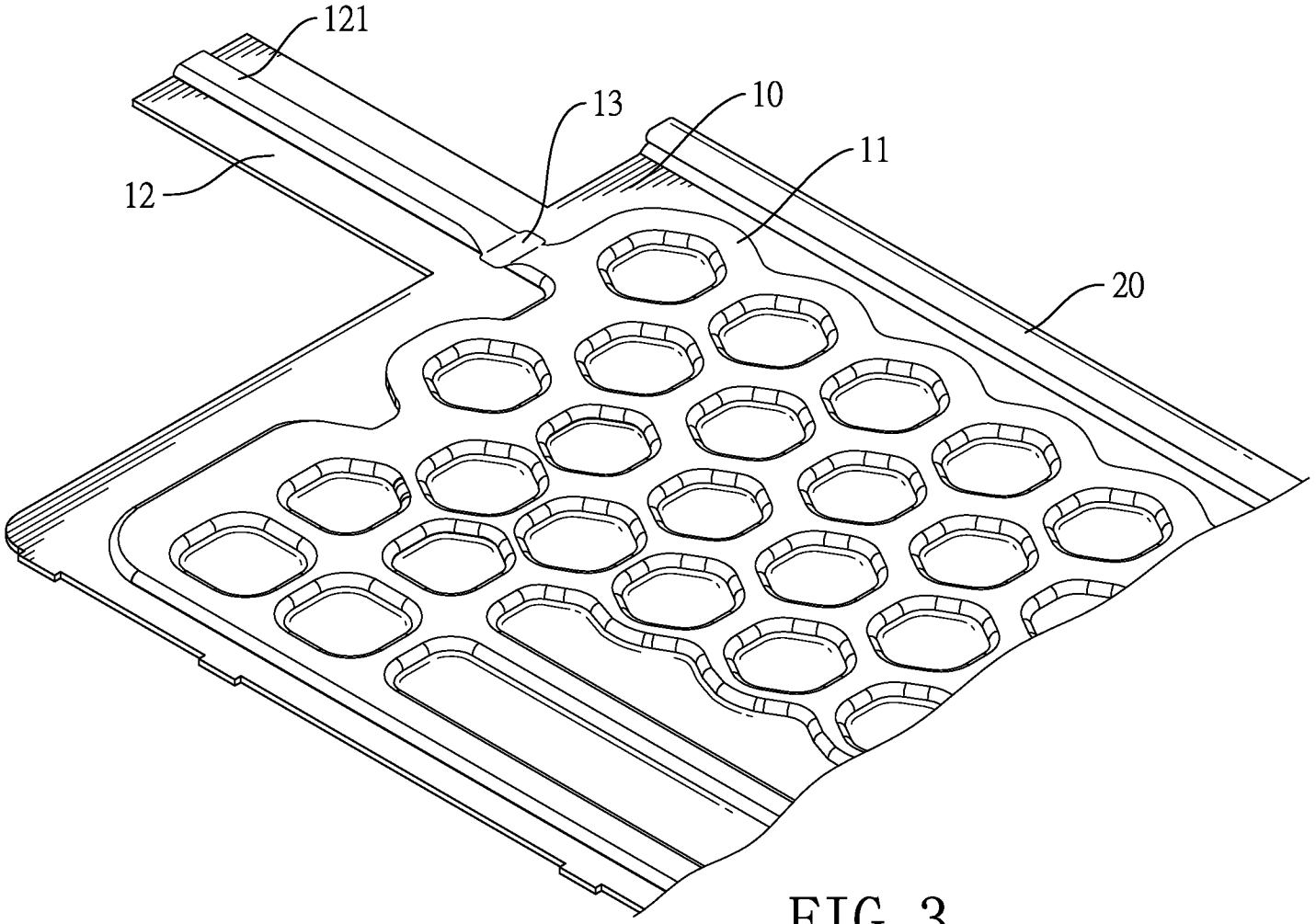
FIG. 3 is an enlarged perspective view of the in-process roll-bond plate in FIG. 1, shown pressed.

(4) A pressing step S4: with reference to FIG. 3, pressing the bulged structure 11 flat to form a pressed portion that is disposed adjacent to the tube 121 by using a pressing device. By pressing the tube 121 flat, the bulged structure 11 is sealed.

Figure 4:
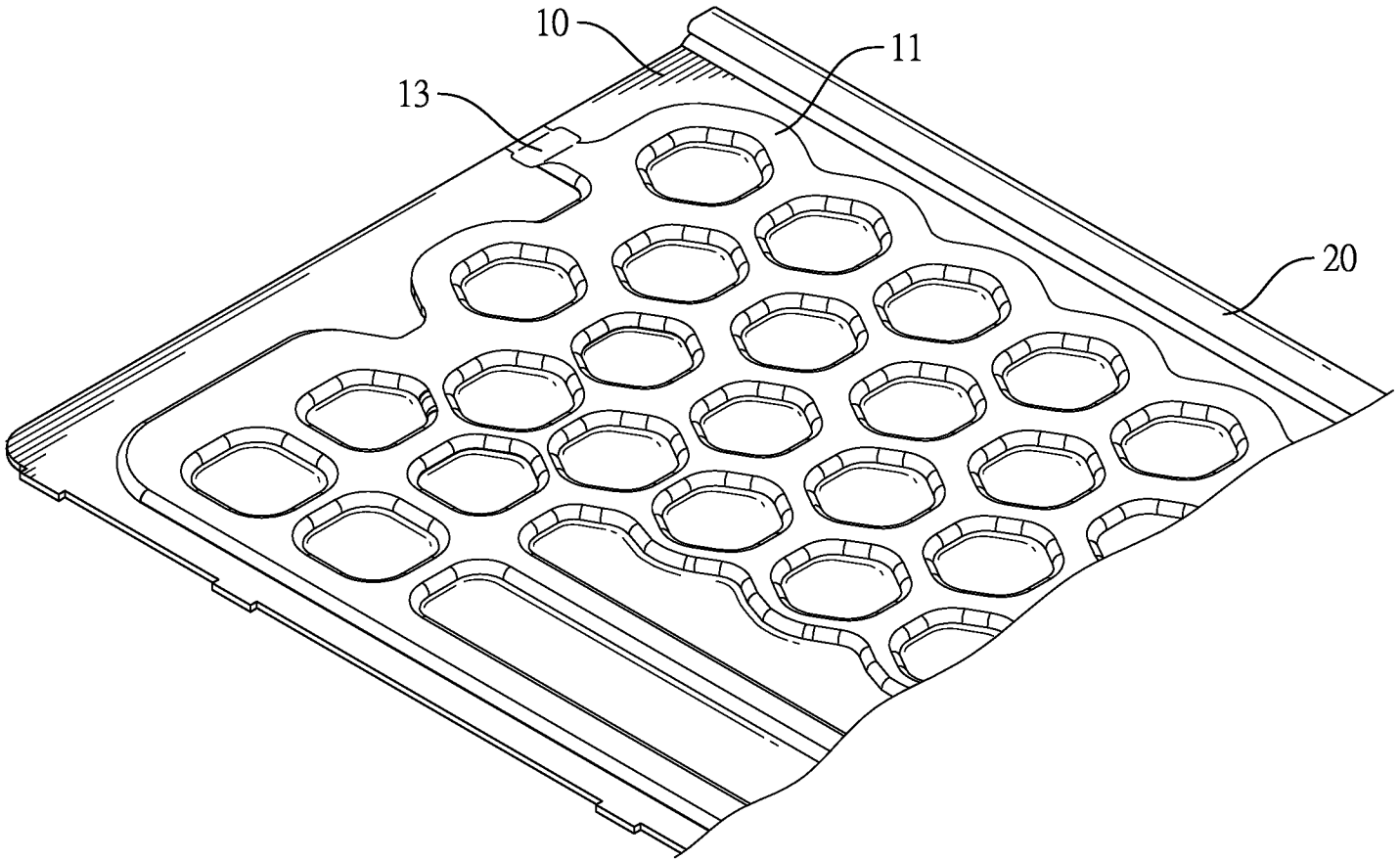
FIG. 4 is an enlarged perspective view of the in-process roll-bond plate in FIG. 1, shown cut.

(5) A cutting step S5: with further reference to FIG. 4, cutting the degassing portion 12 by using a cutting device to form a cut portion 16 on the main plate 10 and the cut portion 16 being flush with the side edge of the main plate 10. After performing the cutting step S5, a slit 14 is formed in the cut portion 16.

Figure 5:
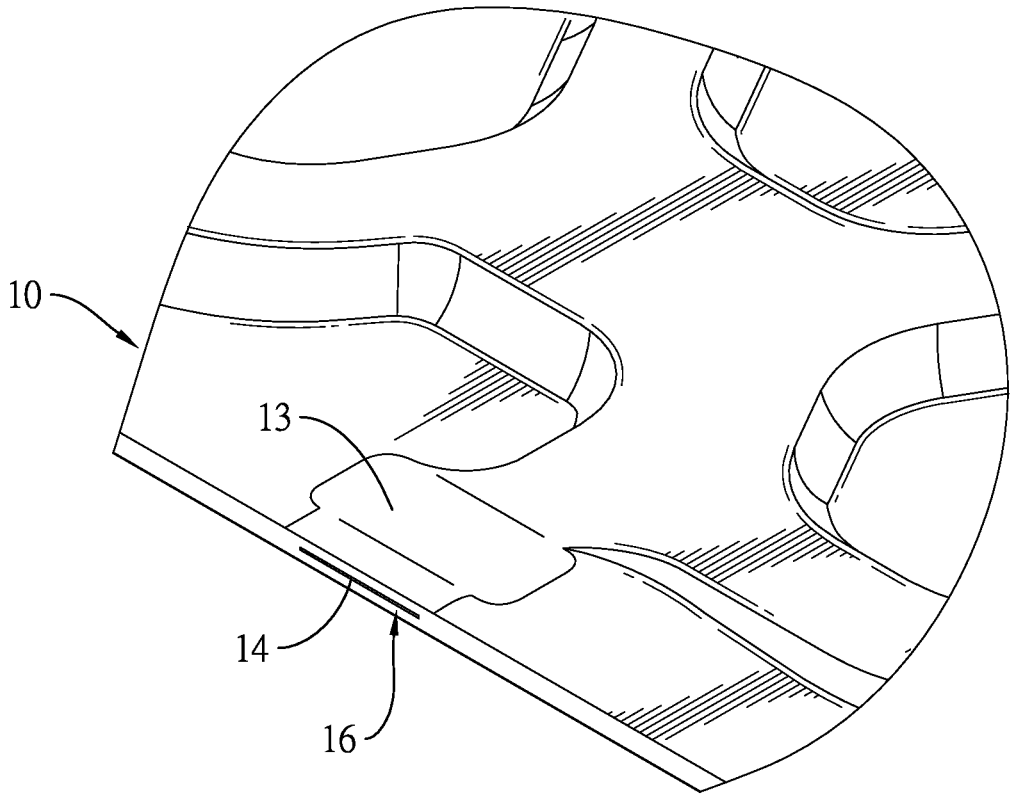
FIG. 5 is an enlarged perspective view of the in-process roll-bond plate in FIG. 1, showing before a cut part is welded.
Figure 6:
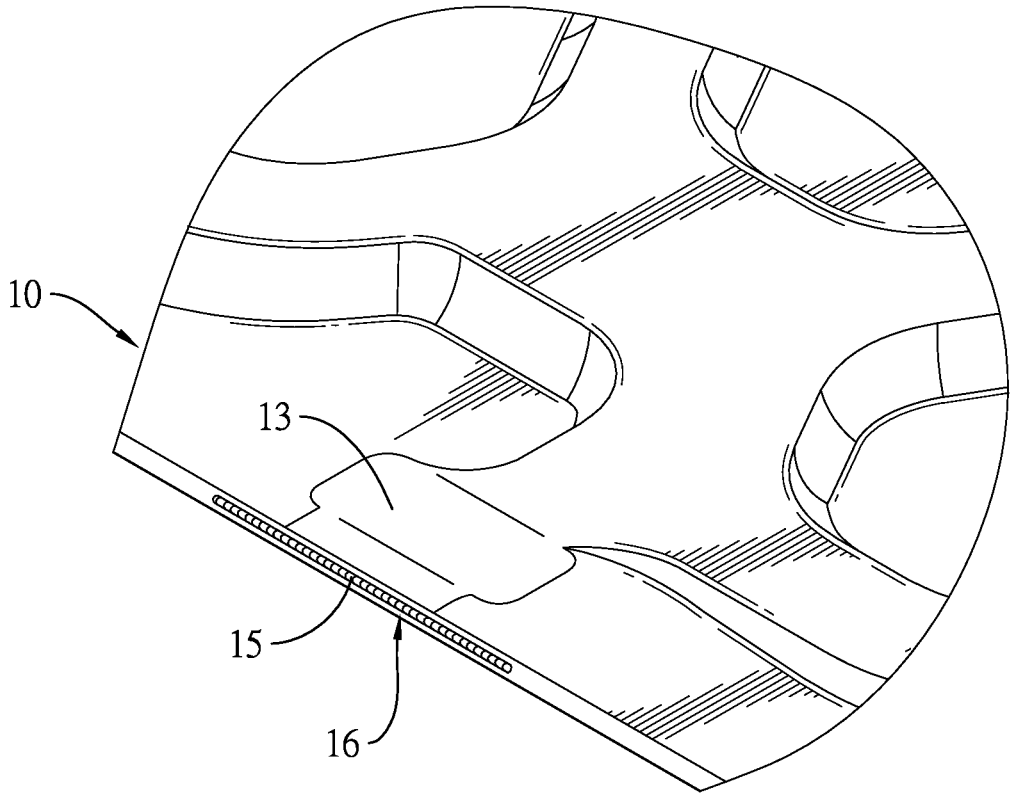
FIG. 6 is an enlarged perspective view of the in-process roll-bond plate in FIG. 1, showing after a cut part is welded.
Figure 7:
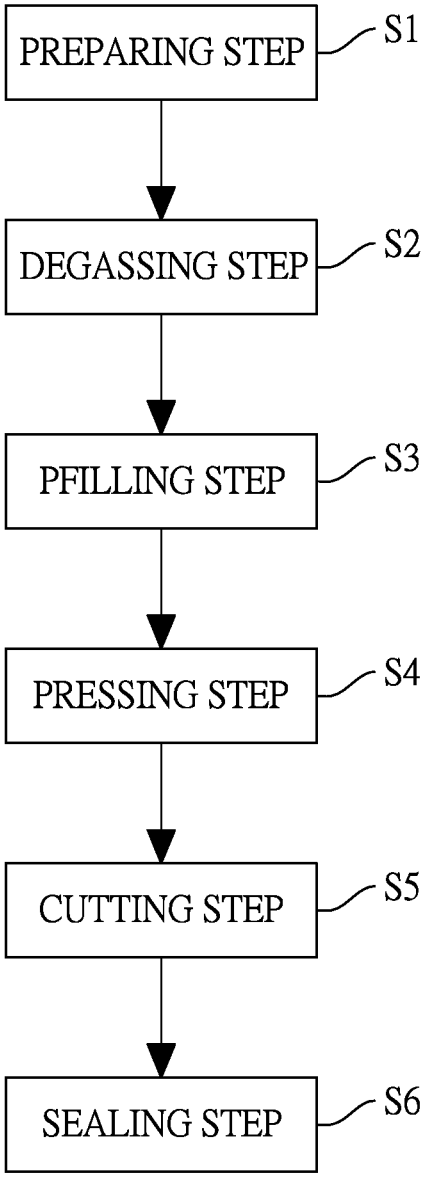
FIG. 7 is a flow chart of a method for manufacturing a roll-bond heat exchanger in accordance with the present invention.
Figure 8:
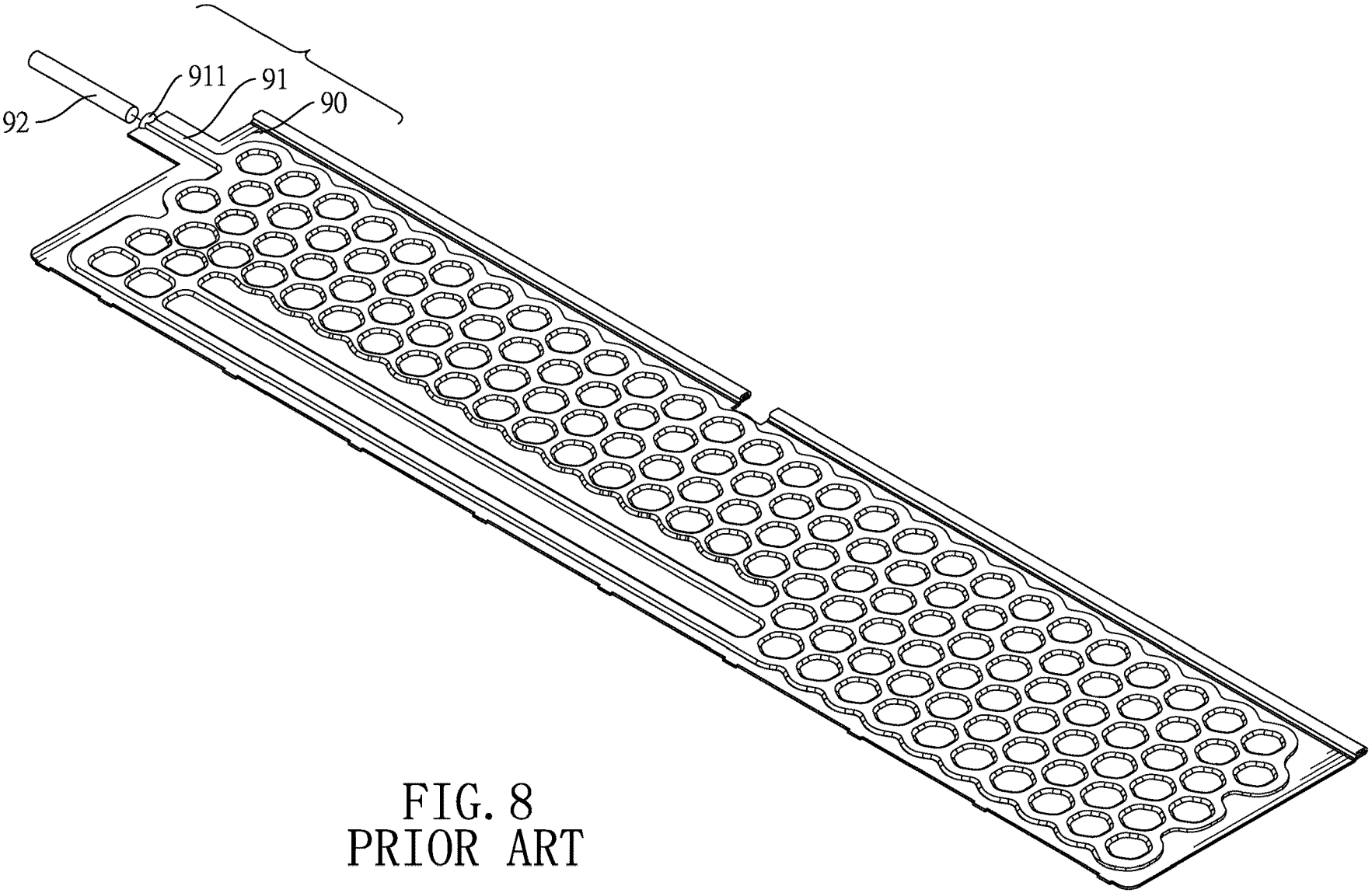
FIG. 8 PRIOR ART
FIG. 8 is an exploded perspective view of a conventional in-process roll-bond plate in accordance with the prior art.
Figure 9:
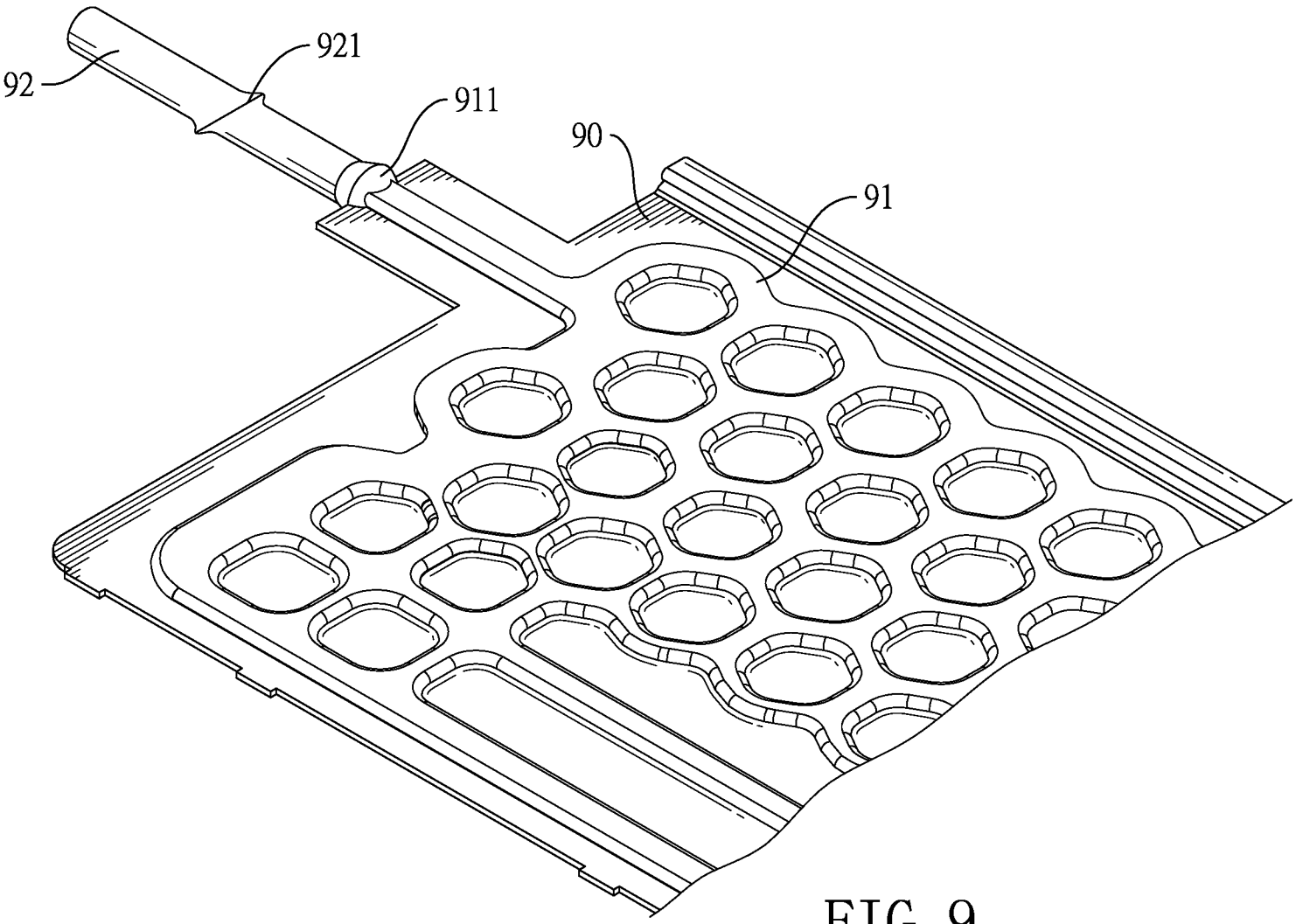
FIG. 9 PRIOR ART
FIG. 9 is an enlarged perspective view of the conventional in-process roll-bond plate in FIG. 8, showing a first pressed portion formed thereon.
Figure 10:
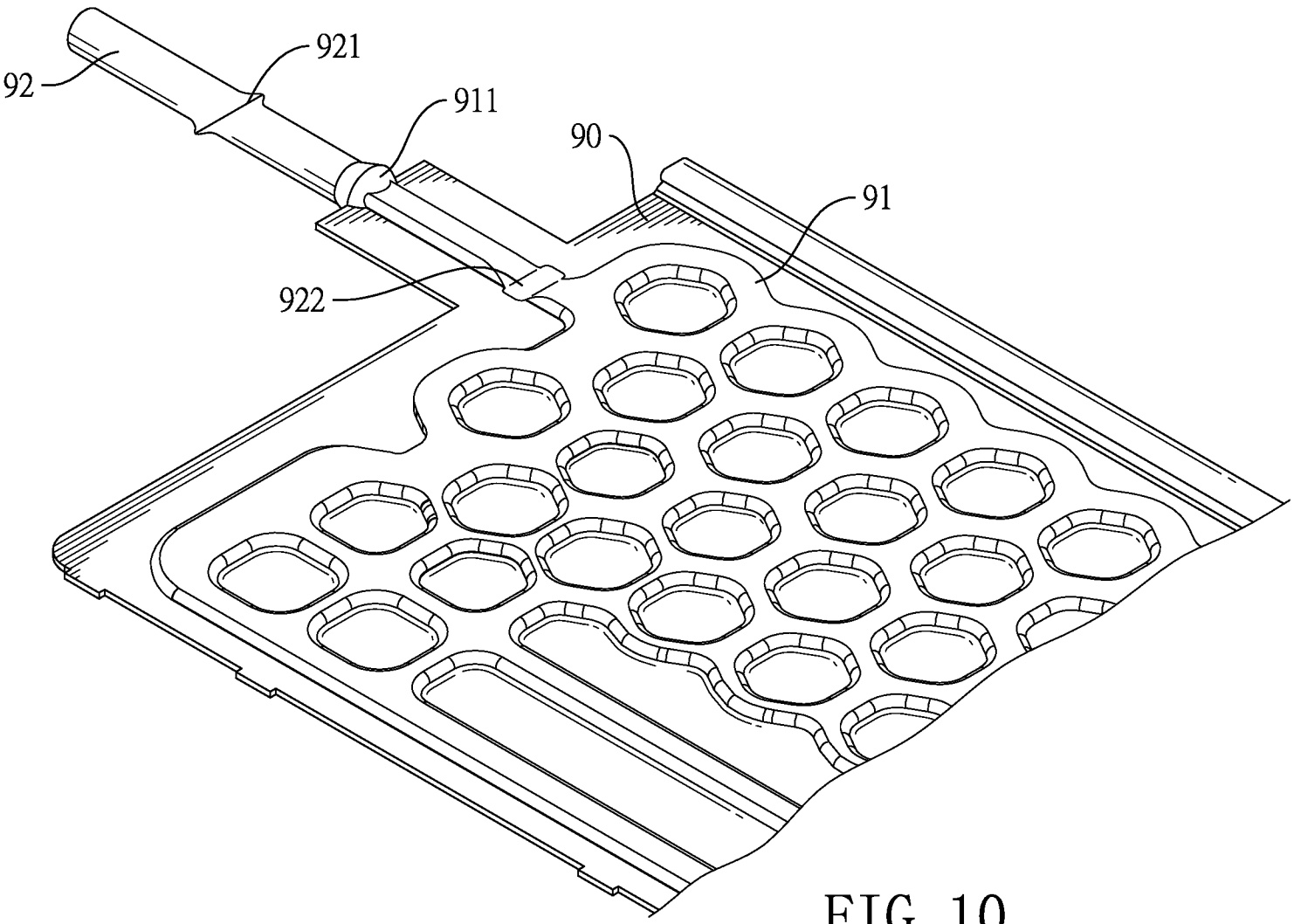
FIG. 10 PRIOR ART
FIG. 10 is an enlarged perspective view of the conventional in-process roll-bond plate in FIG. 8, showing a second pressed portion formed thereon.
Figure 11:
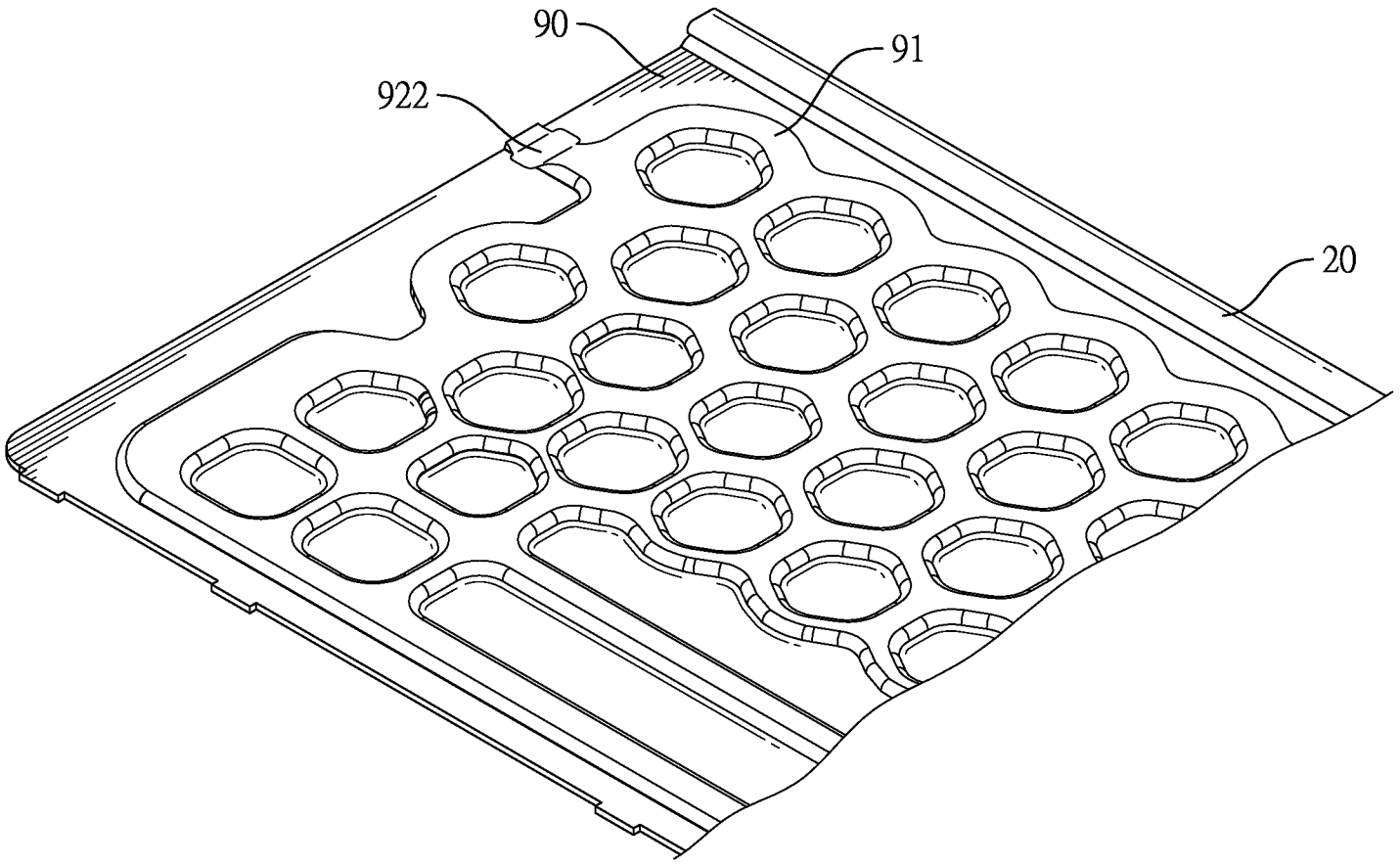
FIG. 11 PRIOR ART
FIG. 11 is an enlarged perspective view of a finished roll-bond heat exchanger manufactured by the conventional in-process roll-bond plate in FIG. 8.

(6) A sealing step S6: with further reference to FIGS. 5 and 6, welding the cut portion 16 and forming a welded portion 15 on the cut portion 16 by using a welding device to seal the slit 14 in the cut portion 16.

The tube 121 of the degassing portion 12 corresponds in size to the connecting tube of the vacuum filling machine. Thus, the tube 121 of the degassing portion 12 is able to be directly connected with the connecting tube of the vacuum filling machine, so as to allow the vacuum filling machine to degas the bulged structure 11 and to fill the refrigerant into the bulged structure 11 without enlarging an opening of the tube 121.

In addition to remove burrs on the cut portion 16, forming the welded portion 15 also further seals the bulged structure 11, such that effect of sealing the bulged structure 11 can be improved.

Since the main plate 10 and the degassing portion 12 are integrally formed as a single part and the degassing portion 12 is able to be directly connected with the vacuum filling machine, it is not needed to additionally weld an adapting tube to the main plate 10 and enlarge the opening of the tube 121. Accordingly, processing steps and manpower for manufacturing the roll-bond heat exchanger are reduced.

Moreover, the U-shaped structure of the insertion portion 20 allows the roll-bond heat exchanger to be firmly and stably inserted on the base of the heat dissipating device.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An in-process roll-bond plate comprising:

a main plate having a first edge, and a bulged structure formed on a side surface of the main plate at a distance from the first edge; and a degassing portion protruding from the first edge of the main plate and having a tube fluidly communicating with the bulged structure, wherein the degassing portion and the main plate are integrally formed as a single part; and the tube of the degassing portion extends across the first edge and has an opening end and a connecting end oppositely defined on the tube, the connecting end of the tube is fluidly connected to the bulged structure of the main plate, and the opening end is on the degassing portion protruding from the first edge for connecting to a vacuum filling machine, a tube cross-section of the tube is uniform from the opening end of the tube to the connecting end of the tube, the bulging structure comprises a first cross-section at the connecting end of the tube, the first cross-section is the same as the tube cross-section, the bulging structure comprises a second cross-section away from the connecting end of the tube, the second cross-section is not the same as the tube cross-section, and a portion of the tube between the first edge of the main plate and the connecting end of the tube is compressible to cut off the fluid connection to the bulged structure when the degassing portion is separated from the main plate at the first edge.

2. The in-process roll-bond plate as claimed in claim 1 further comprising an insertion portion, and the insertion portion being U-shaped in cross-section and formed on a second side edge of the main plate.

3. A method for manufacturing a roll-bond heat exchanger comprising:

a preparing step including preparing an in-process roll-bond plate, wherein the in-process roll-bond plate comprises a main plate and a degassing portion, the main plate has a first edge, and a bulged structure formed on a side surface of the main plate at a distance from the first edge, the degassing portion protrudes from the first edge of the main plate and has a tube communicating with the bulged structure, the degassing portion and the main plate are integrally formed as a single part, the tube of the degassing portion extends across the first edge and has an opening end and a connecting end oppositely defined on the tube, the connecting end of the tube is fluidly connected to the bulged structure of the main plate, a tube cross-section of the tube is uniform from the opening end of the tube to the connecting end of the tube, the bulging structure comprises a first cross-section at the connecting end of the tube, the first cross-section is the same as the tube cross-section, and the bulging structure comprises a second cross-section away from the connecting end of the tube, the second cross-section is not the same as the tube cross-section;

a degassing step including removing air from the bulged structure;

a filling step including filling refrigerant into the bulged structure that has been degassed;

a pressing step including pressing the bulged structure flat to form a pressed portion, wherein the pressed portion extends between the connecting end of the tube and the first edge of the main plate;

a cutting step including cutting the degassing portion to form a cut portion on the main plate at the first edge; and a sealing step including welding the cut portion.

4. The method for manufacturing the roll-bond heat exchanger as claimed in claim 3, wherein in the pressing step, the pressed portion is disposed adjacent to the tube of the degassing portion.

5. The method for manufacturing the roll-bond heat exchanger as claimed in claim 4, wherein in the cutting step, the cut portion is flush with the side edge of the main plate.

6. The method for manufacturing the roll-bond heat exchanger as claimed in claim 3, wherein in the cutting step, the cut portion is flush with the side edge of the main plate.

* * * * *